United States Patent [19]

Usami et al.

[11] Patent Number: 4,942,150

[45] **Date of Patent: * Jul. 17, 1990**

[54] HEAT-SENSITIVE RECORDING MATERIAL

[75] Inventors: Toshimasa Usami; Toshiharu Tanaka; Masataka Kiritani, all of Shizuoka, Japan

[73] Assignee: Fuji Photo Film Co., Ltd., Kanagawa, Japan

[ * ] Notice: The portion of the term of this patent subsequent to Jul. 1, 2003 has been disclaimed.

[21] Appl. No.: 230,818

[22] Filed: Aug. 8, 1988

Related U.S. Application Data

[62] Division of Ser. No. 786,567, Oct. 11, 1985.

[30] Foreign Application Priority Data

Oct. 12, 1984 [JP] Japan ..... 59-213958

[51] Int. Cl.[5] ..... B41M 5/18

[52] U.S. Cl. ..... 503/213; 427/150; 503/214; 503/215; 503/217

[58] Field of Search ..... 427/150–152; 428/913, 914; 503/213, 215, 214, 216–218

[56] References Cited

U.S. PATENT DOCUMENTS 4,233,178 11/1980 Fuchigami ..... 503/215

4,598,035 7/1986 Usami et al. ..... 430/138

*Primary Examiner*—Bruce H. Hess

*Attorney, Agent, or Firm*—Sughrue, Mion, Zinn, Macpeak & Seas

[57] ABSTRACT

A heat-sensitive recording material is disclosed. The material comprises a support having provided on the same surface thereof microcapsules containing a basic colorless dye and an organic solvent, and a developer capable of reacting with the basic colorless dye to develop a color, the capsule walls of said microcapsules being impermeable to either of the basic colorless dye and the developer at room temperature but becoming permeable to the colorless dye and/or the developer upon application of heat. The organic solvent is a compound containing at least two benzene rings in the molecule thereof with a total number of at least one hetero atom selected from nitrogen, sulfur, oxygen and phosphorus atoms, if any, being less than 1/10 a total number of carbon atoms of the organic solvent. The material is excellent in preservability before and after recording and is excellent in heat-developability.

8 Claims, No Drawings

HEAT-SENSITIVE RECORDING MATERIAL

This is a division of application Ser. No. 786,567 filed Oct. 11, 1985.

FIELD OF THE INVENTION

This invention relates to a heat-sensitive recording material and, more particularly, to a heat-sensitive recording material which exhibits excellent preservability before recording, provides recorded images of high density and high stability and is suitable for production.

BACKGROUND OF THE INVENTION

Recording materials used in a heat-sensitive recording process are usually acid-developable heat-sensitive recording materials. However, the recording materials of this type undergo unfavorable discoloration or color formation after recording due to severe handling or contact with adhesive tapes or diazo type copying papers.

Intensive studies on diazo-developable heat-sensitive recording materials have recently been conducted for developing recording materials free from the above-described disadvantages. However, since diazo compounds are inherently labile, the recording materials of this type are susceptible to background coloration under various conditions.

It has been proposed, on the other hand, to improve durability of recorded images by providing a protective layer on general heat-sensitive recording materials. However, formation of a protective layer or an anticurl backing layer on the coated surface or the back surface increases cost of production, though achieving the above-mentioned particular purpose. It has, therefore, been demanded to develop a heat-sensitive material which exhibits excellent durability and can be produced at low cost.

Japanese patent application No. 99490/84(corresponding to U.S. patent application Ser. No. 735,227) and Japanese patent application (OPI) No. 91438/84 (corresponding to U.S. Pat. No. 4,529,681) (the term "OPI" herein used means "unexamined published application") disclose heat-sensitive recording materials comprising a support carrying on the same surface thereof microcapsules containing a basic colorless dye (hereinafter referred to as a leuco dye), a monomer and/or other organic solvents as core materials and a developer which develops the leuco dye. Upon application of heat, a color forming component contained in the core of microcapsules is penetrated out of the capsules through the capsule wall, or an another component outside the capsules which is capable of color formation reaction penetrates into the capsules through capsule walls. In either case, color formation reaction takes place to develop a color.

In the case where microcapsules contain a photopolymerization initiator and a vinyl monomer as core materials as disclosed in Japanese patent application (OPI) No. 91438/84 (corresponding to U.S. Pat. No. 4,529,681), the entire surface of the recording materials after recording is exposed to light to polymerize the vinyl monomer present in the core whereby the color forming component can be prevented from permeation to prevent color development of the non-developed area (i.e., fixation).

Since the color formation mostly takes place within the capsules as confirmed by microscopic observation and the like, the reactants for the color formation are actually isolated from each other by the partitioning capsule walls either before or after the recording even if the above-described fixation is not carried out. Therefore, higher durability and stability than as obtained in the heat-sensitive recording materials having the aforesaid protective layer can be obtained.

Despite of the above-described outstanding characteristics, the heat-sensitive recording materials using microcapsules do not withstand use due to their low color density unless the oil for the core materials is properly selected.

SUMMARY OF THE INVENTION

An object of this invention is to provide a heat-sensitive recording material which is free from reduction of color developability or generation of fog during preservation before recording and which provides a recorded image having a high density and excellent stability.

Another object of this invention is to provide a heat-sensitive recording material which can easily be produced at low cost.

As a result of intensive and extensive investigations, it has now been found that the above objects can be accomplished by a heat-sensitive recording material comprising a support having provided on the same surface thereof microcapsules containing a basic colorless dye and an organic solvent, and a developer capable of reacting with the basic colorless dye to develop a color, the capsule walls of said microcapsules being impermeable to either of the reactants for the basic colorless dye and the developer at room temperature but becoming permeable to the basic colorless dye and/or the developer upon application of heat with a thermal head to thereby provide a color image, wherein said organic solvent is a compound containing at least two benzene rings in the molecule thereof with a total number of at least one hetero atom selected from nitrogen, sulfur, oxygen and phosphorus atoms, if any, being less than 1/10 a total number of carbon atoms of the organic solvent.

Use of the above-described specific organic solvents prevents generation of fog and, therefore, eliminates the necessity to incorporate vinyl compounds or any other sensitizers in microcapsules for the purpose of prevention of fog, thus resulting in an increased recorded density.

DETAILED DESCRIPTION OF THE INVENTION

The microcapsules according to the present invention are not of those types which are destroyed by pressure or heat to contact the reactant contained in the core thereof with the reactant outside the microcapsules but of such a type wherein the microcapsule walls are rendered permeable to thereby allow the reactants present inside and outside the capsule walls to react upon application of heat.

It is known that microcapsule walls formed by polymerization are not perfectly impermeable. The permeability of such microcapsule walls is known as such that low molecular weight substances slowly permeate over a long period of time. The microcapsule walls according to the present invention are not necessarily required to be melted by heat. It was found that capsule walls having higher melting points rather produce superior results in terms of preservability.

When the microcapsules formed by the process of the present invention from which the core materials have been removed are heated, the capsule walls are not apparently melted. Instead, the capsule walls are converted from a glassy state to rubbery state upon instantaneous heating with a thermal head whereby the color forming reactants are diffused through the walls and contacted with each other to cause the color formation reaction.

The color forming characteristics of heat-sensitive recording materials are intimately correlated to a glass transition temperature inherent to the capsule-forming substance or a glass transition temperature snythetically determined taking into consideration the influences of various glass transition temperature-controlling agents present outside the capsules.

When an organic solvent having at least two benzene rings and having a total number of hetero atoms less than 1/10 a total number of carbon atoms is used as a core oil, the rate of color development upon heat recording and a developed color density are increased and fog is lessened.

The above-described organic solvents according to the present invention are characterized by the high solubility for leuco dyes and suitability for encapsulation as well as capability to provide high color density upon instantaneous heating with a thermal head.

The preferred organic solvents of this invention include compounds represented by the following formulae (I) to (III):

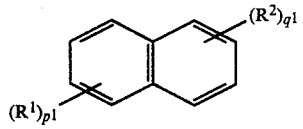

(I)

wherein $R^1$ represents a hydrogen atom or an alkyl group having from 1 to 18 carbon atoms; $R^2$ represents an alkyl group having from 1 to 18 carbon atoms; and $p^1$ and $q^1$ each represents an integer of from 1 to 4, with the proviso that the total number of alkyl groups does not exceed 4;

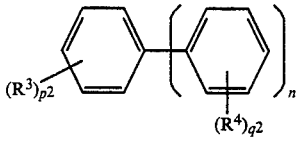

(II)

wherein $R^3$ represents a hydrogen atom or an alkyl group having from 1 to 12 carbon atoms; $R^4$ represents an alkyl group having from 1 to 12 carbon atoms; n represents 1 or 2; and $p^2$ and $q^2$ each represents an integer of from 1 to 4, with the proviso that the total number of alkyl groups does not exceed 4 or 6 when n is 1 or 2, respectively;

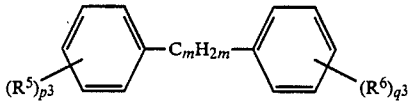

(III)

wherein $R^5$ and $R^6$, which may be the same or different, each represents a hydrogen atom or an alkyl group having from 1 to 18 carbon atoms; m represents an integer of from 1 to 13; and $p^3$ and $q^3$ each represents an integer of from 1 to 3, with the proviso that the total number of alkyl groups does not exceed 3.

In the above-described formula (I), the alkyl group as represented by $R^1$ or $R^2$ preferably contains from 1 to 8 carbon atoms.

In the formula (III), the alkyl group as represented by $R^5$ or $R^6$ preferably contains from 2 to 4 carbon atoms.

Specific examples of the compounds represented by the formula (I) include dimethylnaphthalene, diethylnaphthalene, diisopropylnaphthalene, etc.

Specific examples of the compounds represented by the formula (II) include dimethylbiphenyl, diethylbiphenyl, diisopropylbiphenyl, diisobutylbiphenyl, etc.

Specific examples of the compounds represented by the formula (III) are 1-methyl-1-dimethylphenyl-1 -phenylmethane, 1-ethyl-1-dimethylphenyl-1-phenylmethane, 1-propyl-1-dimethylphenyl-1-phenylmethane, etc.

The preferred organic solvents which can be used in the present invention further include triarylmethanes, e.g., tritoluylmethane, toluyldiphenylmethane, etc.; terphenyl compounds, e.g., terphenyl, etc.; alkylated diphenyl ethers, e.g., propyldiphenyl ether, etc.; hydrogenated terphenyls, e.g., hexahydroterphenyl, etc.; diphenyl ether; and the like.

These organic solvents can be used alone or in combinations thereof or in combinations with other organic solvents.

The microcapsules according to the present invention can be formed by emulsifying core materials and then forming walls comprising polymeric substances around oil droplets of the emulsion. The reactants for forming the polymeric substances are added to the inside and/or outside the oil droplets.

The organic solvent is used in an amount of from 2 to 50 parts by weight, and preferably from 3 to 25 parts by weight, per part by weight of a basic colorless dye.

Examples of the polymeric substances for capsule walls include polyurethane, polyurea, polyamide, polyester, urea-formaldehyde resins and mixed systems thereof.

Processes for encapsulation and specific examples of compounds used are described in U.S. Pat. Nos. 3,726,804 and 3,796,669. For example, in the case when polyureapolyurethane is used as a material for the capsule walls, a polyisocyanate and a second substance capable of reacting with the polyisocyanate to form capsule walls, such as polyols or polyamines, are mixed in an aqueous phase or an oily medium to be encapsulated, and emulsified and dispersed therein. Then, the temperature of the mixture is elevated to cause polymerization on the interface of oil droplets to thereby form microcapsule walls.

In this encapsulation, the oily medium may contain an auxiliary solvent having a strong dissolving power and a low boiling point. The polyurea can be formed even if the aforesaid second additive is not present.

Examples of polyisocyanates, polyols and polyamines which can be used in the above-described encapsulation are given in U.S. Pat. Nos. 3,281,383, 3,773,695 and 3,793,268, Japanese Patent Publication Nos. 40347/73 and 24159/74 and Japanese patent application (OPI) Nos. 80191/73 and 84086/73.

In the encapsulation, water-soluble polymers can be used as protective colloids. The water-soluble polymers include water-soluble anionic, nonionic and amphoteric polymers.

The anionic polymers may be either natural or synthetic and include those having —COO—, —$SO_3$— or like groups. Specific examples of such anionic polymers include natural products, e.g, gum arabic, alginic acid, etc.; semi-synthetic products, e.g., carboxymethyl cellulose, phthalylated gelatin, starch sulfate, cellulose sulfate, lignin sulfonic acid, etc.; and synthetic products, e.g., maleic anhydride (or hydrolysate thereof) copolymers, (meth)acrylic acid polymers or copolymers, vinylbenzenesulfonic acid polymers or copolymers, carboxyl-modified polyvinyl alcohol, etc.

The nonionic polymers include polyvinyl alcohol, hydroxyethyl cellulose, methyl cellulose, etc.

The amphoteric polymers include gelatin, etc.

These water-soluble polymers are used as an aqueous solution at a concentration of from 0.01 to 10% by weight.

The basic colorless dyes (leuco dyes) which can be used in the heat-sensitive recording materials of the present invention are not particularly restricted as long as they donate an electron or accept a proton, such as an acid, to develop a color. Compounds that are substantially colorless and have a partial skeleton which is opened or cleaved upon contact with a developer, such as a lactone, a lactam, a sultone, a spiropyran, an ester, an amide, etc., are usually employed as leuco dyes.

Specific examples of such leuco dyes are Crystal Violet lactone, benzoyl leucomethylene blue, Malachite Green lactone, Rhodamine B lactam, 1,3,3-trimethyl-6'-ethyl-8'-butoxyindolinobenzospiropyran, etc.

The developers capable of reacting with the above-described color formers include phenol compounds, organic acids or metal salts thereof, hydroxybenzoic acid esters, and the like. The preferred among them are sparingly water-soluble phenol compounds and organic acids having a melting point of from 50° to 250° C., and more preferably from 60° to 200° C.

Specific examples of the phenol compounds are 4,4'-isopropylidene-diphenol (bisphenol A), p-t-butylphenol, 2,4-dinitrophenol, 3,4-dichlorophenol, 4,4'-methylenebis(2,6-di-t-butylphenol), p-phenylphenol, 4,4-cyclohexylidenediphenol, 2,2'-methylenebis(4-t-butylphenol), 2,2'-methylenebis(α-phenyl-p-cresol)thiodiphenol, 4,4'-thiobis(6-t-butyl-m-cresol), sulfonyldiphenol, 1,1-bis(4-hydroxyphenyl)-n-dodecane, 4,4-bis(4-hydroxyphenyl)-1-pentanoic acid ethyl ester, a p-t-butylphenol-formalin condensate, a p-phenylphenol-formalin condensate, etc.

Specific examples of useful organic acids and metal salts thereof are 3-t-butylsalicyclic acid, 3,5-t-butylsalicylic acid, 5-α-methylbenzylsalicylic acid, 3,5-di-α-methylbenzylsalicylic acid, 3-t-octylsalicylic acid, 5-αγ,Y-dimethyl-α-phenyl-γ-phenylpropylsalicylic acid, etc. and zinc salts, lead salts, aluminum salts, magnesium salts, nickel salts, etc. of these acids.

Specific examples of the hydroxybenzoic acid esters include ethyl p-hydroxybenzoate, butyl p-hydroxybenzoate, heptyl p-hydroxybenzoate, benzyl p-hydroxybenzoate, etc.

These developers are used after being solid-dispersed in a water-soluble high polymer as a protective colloid using a sand mill, etc.

The above-described leuco dye and developer are coated on a support in amounts of from 0.05 to 1.5 g/m$^2$, and preferably from 0.1 to 0.5 g/m$^2$, and from 0.5 to 8 g/m$^2$, and preferably from 0.5 to 4 g/m$^2$, respectively.

The heat-sensitive recording materials according to the present invention can contain pigments, such as silica, barium sulfate, titanium oxide, aluminum hydroxide, zinc oxide, calcium carbonate, etc., and fine powders, such as styrene beads, urea-melamine resins, etc., for the purpose of preventing sticking to a thermal head or improving writability.

Further, metal soaps may also be added in an amount of from 0.2 to 7 g/m$^2$ for the purpose of preventing sticking to a thermal head.

The coating composition can be coated on a support with the aid of an appropriate binder. The binder which can be used includes emulsions of polymers, such as polyvinyl alcohol, methyl cellulose, carboxymethyl cellulose, hydroxypropyl cellulose, gum arabic, gelatin, polyvinylpyrrolidone, casein, a styrene-butadiene latex, an acrylonitrile-butadiene latex, polyvinyl acetate, a polyacrylate, an ethylene-vinyl acetate copolymer, etc. The amount of the binder to be used ranges from 0.5 to 5 g/m$^2$ on a solid basis.

The heat-sensitive recording material can be produced by coating a coating composition comprising the above-described components on a support, such as paper, a synthetic resin film, etc., by a conventional coating method, such as bar coating, blade coating, air knife coating, gravure coating, roll coating, spray coating, dip coating, and the like, and drying the coating film to form a heat-sensitive layer having a solid content of from 2.5 to 25 g/m$^2$.

In view of preservability with the passage of time, the paper to be used as a support is advantageously a neutral paper prepared by thermal extraction at pH 6 to 9 and sized with a neutral sizing agent, e.g., alkyl ketene dimers, as described in Japanese patent application (OPI) No. 14281/80 (corresponding to U.S. Pat. No. 4,255,491).

In order to prevent penetration of a coating composition into the paper support and to ensure good contact between a thermal head and a heat-sensitive recording layer, the paper support advantageously has the ratio $$\frac{\text{stocking sizing degree}}{(\text{meter weighing capacity})^2} \geqq 3 \times 10^{-3}$$

and a Beck's degree of surface smoothness of 90 seconds or more, as described in U.S. Pat. No. 4,416,939.

Further, paper supports which can be used to advantage in the present invention additionally include the paper having an optical surface roughness of not more than 8 μm and a thickness of from 40 to 75 μm as disclosed in Japanese patent application (OPI) No. 136492/83, the paper free from penetration of a coating composition which is prepared from pulp beaten to a Canadian Standard freeness of 400 cc or more (JIS P8121) as described in Japanese patent application (OPI) No. 69091/83, the paper which is prepared by means of a Yankee machine and has improved color density and resolving power, the glossy surface of which is to be applied with a coating composition, as described in Japanese patent application (OPI) No. 65695/83 (corresponding to U.S. Pat. 4,466,007), and the paper having been subjected to corona discharge treatment so as to have improved suitability for coating as described in Japanese patent application (OPI) No. 136492/83. In addition, any of supports conventionally employed in the field of heat-sensitive recording materials can also be used in the present invention.

The present invention will now be illustrated in greater detail with reference to the following examples and comparative examples, but it should be understood that these examples are not limiting the present invention. In the examples, all parts and percents are by weight unless otherwise indicated.

EXAMPLE 1

Two parts of 2-methyl-3-anilino-7-cyclohexyl-N-methylaminofluoran as a color former and 18 parts of a 3:1 adduct of toluylene diisocyanate and trimethylolpropane were dissolved in a mixed solvent of 24 parts of 1-phenyl-1-xylylethane and 5 parts of dichloromethane. The resulting leuco dye solution was added to an aqueous solution of 3.5 parts of polyvinyl alcohol, 1.7 parts of gelatin and 2.4 parts of 1,4-di(hydroxyethoxy)benzene in 58 parts of water. The mixture was dispersed and emulsified at 20° C. to obtain an amulsion having an average particle size of 3 μm. To the resulting emulsion was added 100 parts of water, and the mixture was heated to 60° C. for 2 hours while stirring to obtain a capsule dispersion containing the leuco dye as a core material.

Separately, 20 parts of bisphenol A was dispersed in 100 parts of a 5% aqueous solution of polyvinyl alcohol by means of a sand mill for about 24 hours to obtain a bisphenol A dispersion having an average particle size of 3 μm.

Five parts of the capsule dispersion as above prepared and 3 parts of the bisphenol A dispersion were mixed, and the resulting coating composition was coated on a fine paper having a smooth surface and a basis weight of 50 g/m$^2$ to a dry weight of 6.5 g/m$^2$, and dried at 55° C. for 25 minutes to prepare a heat-sensitive recording material.

EXAMPLE 2

A heat-sensitive recording material was produced in the same manner as described in Example 1 but using diisopropylnaphthalene in place of 1-phenyl-1-xylylethane.

EXAMPLE 3

A heat-sensitive recording material was produced in the same manner as described in Example 1 but using benzylpropyl ether in place of 1-phenyl-1-xylylethane.

COMPARATIVE EXAMPLE 1

A heat-sensitive recording material was obtained in the same manner as described in Example 1 but using methylphenyl ether in place of 1-phenyl-1-xylylethane.

COMPARATIVE EXAMPLE 2

A heat-sensitive recording material was obtained in the same manner as described in Example 1 except for using phenylpropyl ether in place of 1-phenyl-1-xylylethane.

COMPARATIVE EXAMPLE 3

A heat-sensitive recording material was obtained in the same manner as described in Example 1 except for using dibutyl phthalate in place of 1-phenyl-1-xylylethane.

COMPARATIVE EXAMPLE 4

Twenty parts of the same leuco dye as used in Example 1 were dispersed in 100 parts of a 5% aqueous solution of polyvinyl alcohol for about 24 hours by means of a sand mill to obtain a leuco dye dispersion having an average particle size of 3 μm.

Then, 0.6 part of the above obtained leuco dye dispersion and 3 parts of the same bisphenol A dispersion as prepared in Example 1 were mixed to prepare a coating composition. The coating composition was coated on a smooth fine paper having a basis weight of 50 g/m$^2$ to a dry weight of 4.5 g/m$^2$ and dried at 55° C. for 25 minutes to obtain a heat-sensitive recording material.

Heat recording was conducted on each of the thus obtained seven samples using a thermal printer ("Hi-Fax 700" manufactured by Hitachi Ltd.), and the color density and background density were determined using a Macbeth densitometer.

Further, the sample was evaluated for preservability before recording by subjecting the sample to a forced deterioration test at 40° C. and 90% RH for 1 day and measuring the density of a recorded image. Furthermore, the resistance against contact with a diazo type paper was evaluated by determining fog of the background when contacted with a diazo type paper immediately after copying for 1 hour.

The results obtained are shown in Table 1.

TABLE 1

| Example No. | Fog | Color Density | Color Density after Forced Deterioration | Fog after Contact with Diazo Paper |
|---|---|---|---|---|
| Example 1 | 0.07 | 1.23 | 1.21 | none |
| Example 2 | 0.08 | 1.21 | 1.22 | " |
| Example 3 | 0.08 | 0.89 | 0.74 | " |
| Comparative Example 1 | 0.08 | 0.27 | 0.27 | " |
| Comparative Example 2 | 0.11 | 0.45 | 0.41 | " |
| Comparative Example 3 | 0.12 | 0.37 | 0.38 | " |
| Comparative Example 4 | 0.08 | 1.23 | 1.23 | 1.21 |

As can be seen from the results of Table 1, the samples according to the present invention (Examples 1 to 3) provide higher color densities either before and/or after the forced deterioration test as compared with those of the comparative samples.

Further, it can also be seen that the samples of the present invention are free from fog generation upon contact with a diazo type copying paper as observed in conventional heat-sensitive recording materials (Comparative Example 4).

Thus, the heat-sensitive recording materials in accordance with the present invention are excellent in preservability and heat developability.

While the invention has been described in detail and with reference to specific embodiments thereof, it will be apparent to those skilled in the art that various changes and modifications can be made therein without departing from the spirit and scope thereof.

What is claimed is:

1. A heat-sensitive recording material comprising a support having provided on the same surface thereof microcapsules containing a basic colorless dye and an organic solvent, and a developer capable of reacting with the basic colorless dye to develop a color, the capsule walls of said microcapsules being impermeable to said basic colorless dye and said developer at room temperature but becoming permeable to said basic colorless dye and/or said developer upon application of heat with a thermal head to thereby provide a color image, wherein said organic solvent is a compound containing at least two benzene rings, and said organic solvent may further contain at least one hetero atom selected from the group consisting of nitrogen, sulfur, oxygen and phosphorus atoms, the total number of hetero atoms constituting less than 10% of the total number of carbon atoms of said organic solvent, said organic solvent being selected from the group consisting of compounds represented by formula (I):

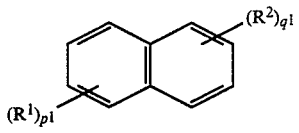

(I)

wherein $R^1$ represents a hydrogen atom or an alkyl group having from 1 to 18 carbon atoms; $R^2$ represents an alkyl group having from 1 to 18 carbon atoms; and $p^1$ and $q^1$ each represents an integer of from 1 to 4, with the proviso that the total number of alkyl groups does not exceed 4.

2. A heat-sensitive recording material as in claim 1, wherein the alkyl group as represented by $R^1$ or $R^2$ in the formula (I) has from 1 to 8 carbon atoms.

3. A heat-sensitive recording material as in claim 1, wherein said organic solvent is used in an amount of from 2 to 50 parts by weight per part by weight of the basic colorless dye.

4. A heat-sensitive recording material as in claim 3, wherein said organic solvent is used in an amount of from 3 to 25 parts by weight per part by weight of the basic colorless dye.

5. A heat-sensitive recording material as in claim 1, wherein said basic colorless dye is a compound having a partial skeleton selected from a lactone, a lactam, a sultone, a spiropyran, an ester and an amide.

6. A heat-sensitive recording material as in claim 1, wherein said developer is a compound selected from phenol compounds, organic carboxylic acids or metal salts thereof, and hydroxybenzoic acid esters.

7. A heat-sensitive recording material as in claim 1, wherein said basic colorless dye is coated on the support in amounts of from 0.05 to 1.5 $g/m^2$ and said developer is coated on the support in amounts of from 0.5 to 8 $g/m^2$.

8. A heat-sensitive recording material as in claim 7, wherein the amount of said basic colorless dye coated is 0.1 to 0.5 $g/m^2$ and the amount of said developer coated is 0.5 to 4 $g/m^2$.

* * * * *